US005329789A

United States Patent [19]

Mandelbaum

[11] Patent Number: 5,329,789

[45] Date of Patent: Jul. 19, 1994

[54] JEWELRY WITH TUBULAR APPEARANCE

[75] Inventor: Jonathan Mandelbaum, Forest Hills, N.Y.

[73] Assignee: Almond Jewelers Inc., Westbury, N.Y.

[21] Appl. No.: 59,084

[22] Filed: May 5, 1993

[51] Int. Cl.[5] ..... A44C 25/00

[52] U.S. Cl. ..... 63/2; 428/28

[58] Field of Search ..... 63/2, 12, 13, 20, 23; 428/28, 65; 29/160.6

[56] References Cited

U.S. PATENT DOCUMENTS

| | | | |
|---|---|---|---|
| 169,993 | 11/1875 | Hirner . | |
| 271,084 | 1/1883 | Krenentz | 63/12 |
| 944,640 | 12/1909 | Ungerer | 29/160.6 |
| 1,976,093 | 9/1933 | Raymond . | |
| 2,148,990 | 7/1937 | Jordan . | |
| 2,197,577 | 1/1938 | Crosser . | |
| 2,647,379 | 8/1953 | Ferro | 63/12 |
| 3,353,372 | 11/1967 | Rapaport . | |
| 3,933,009 | 1/1976 | Ireland . | |
| 4,086,786 | 5/1978 | Ritter | 63/13 |
| 4,828,889 | 5/1989 | Sacco | 63/2 |
| 5,184,481 | 2/1993 | Joseph et al. . | |

FOREIGN PATENT DOCUMENTS

| | | | |
|---|---|---|---|
| 791837 | 9/1934 | France | 63/2 |
| 907214 | 1/1945 | France | 63/14 |
| 689825 | 4/1965 | Italy | 63/2 |

*Primary Examiner*—Flemming Saether
*Attorney, Agent, or Firm*—Notaro & Michalos

[57] ABSTRACT

A piece of jewelry comprises one or more half-tubular members which have a main curvature lying in the primary plane of the jewelry. The half-tubular member has an outer, highly polished concave surface and an inner, highly polished convex surface where both surfaces lie or extend in the primary plane. This produces the illusion that the half-tubular members are in fact fully tubular and thus, produces jewelry that has a heavier look and impression even though it is made with half the precious metal.

16 Claims, 4 Drawing Sheets

JEWELRY WITH TUBULAR APPEARANCE

FIELD AND BACKGROUND OF THE INVENTION

The present invention relates in general to jewelry, and in particular to a new and useful piece of jewelry, in the form of an earring, a broach, a pendant, or other similar jewelry to be worn, which has elements that appear to be full and tubular but in fact are only half tubes.

U.S. Pat. No. 169,993 (1875) discloses elongated concave elements for use in a decorative fringe. The elements are straight and not curved in a main plane of the fringe nor do they include inner and outer highly polished surfaces. As will be more apparent with a full reading of this Specification, U.S. Pat. No. 169,993 would not produce the tubular appearance and illusion of the present invention, which, with only half as much material, produces the appearance that the jewelry is made of fully tubular elements having the corresponding size and mass.

U.S. Pat. No. 3,353,372 discloses a pair of half-tubular members which are permanently attached to each other to form a pierced earring hoop. There is no hint or suggestion that the inner surface of the half-tubes should in anyway be treated since they are not visible when the jewelry is worn.

Other patents that disclose the use of tubular elements in jewelry are U.S. Pat. No. 3,933,009 and U.S. Pat. No. 5,184,481.

Referring to FIGS. 1 and 2, it has been known to manufacture jewelry, in particular earrings, using a ring-shaped element designated 20 having a half-tubular cross section best shown in FIG. 2. This jewelry could only be used with the half-tubular sections lying in a plane which is transverse to the primary plane of the piece of jewelry. The plane of the ring is the plane of the page shown in FIG. 1 or plane P in FIG. 2. Jewelry made with ring 20 must be oriented to have a main plane which is transverse to the plane P, that is the plane of the page in FIG. 2. In this way, the viewer sees the outer convex surface of the ring only and does not see the edge of the ring, for example, if viewed in direction A in FIG. 2. If the jewelry is seen from direction A, the viewer immediately perceives that the ring 20 is not a fully tubular member but rather a half-tubular member. Thus, in all jewelry using one or more rings 20 of the prior art, the rings are always oriented to be substantially edge-wise to the viewer.

Since fine jewelry is made of precious metals, it is always advantageous to find ways of reducing the amount of metal in a piece of jewelry while still maintaining an appearance of substantial size and mass.

SUMMARY OF THE INVENTION

An object of the present invention is to provide jewelry which includes one or more half-tubular elements that, despite the half-tubular structure of the element(s) still give the appearance and impression of fully tubular elements in the piece of jewelry.

To achieve this purpose, the present inventor has found that the half-tubular member must be shaped in a particular manner with respect to the main plane of the jewelry, and further, have highly polished inner and outer surfaces. Such highly polished surfaces are referred to in the industry as a "mirror finish" and can only be achieved with a final and distinct polishing step which is advantageously manual and involves polishing both the outer and inner surfaces of each half-tubular member that makes up the piece of jewelry.

Accordingly, a further object of the present invention is to provide a piece of jewelry having a main or primary plane and which comprises at least one-half tubular member with a main curvature in the primary plane, the member having an outer polished convex surface extending along the primary plane, and an inner polished concave surface which is opposite from the convex surface and which also extends along the primary plane.

The main curvature extends in a longitudinal direction along the half-tubular member with a width of the member being relatively small compared to its longitudinal length.

The inventor has found that by following these limitations, a viewer perceives the half-tubular member to be fully tubular. This is believed to involve an optical illusion caused by both the outer and inner polished surfaces which appear to the viewer to be fully tubular, that is fully cylindrical, when viewed in the primary plane and even when viewed at acute angles to the plane.

By using such a member in the manufacture of various types of jewelry, in particular earrings, broaches, and pendants, the jewelry has an appearance of great value in that the viewer believes the pieces are made of fully tubular, large and relatively heavy parts of precious metal, where in fact the pieces are made of thin-walled half-tubular members.

Another object of the present invention is to provide jewelry made of at least one half-tubular member which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
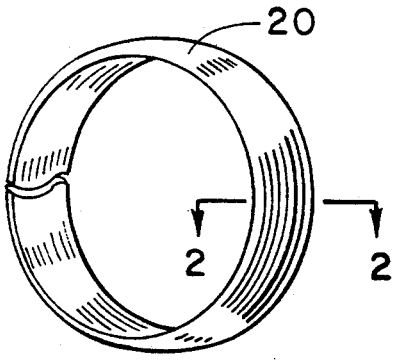
FIG. 1 (PRIOR ART)
FIG. 1 is a perspective view taken substantially from the side of a prior art half-tubular member used for making jewelry pieces.
Figure 2:
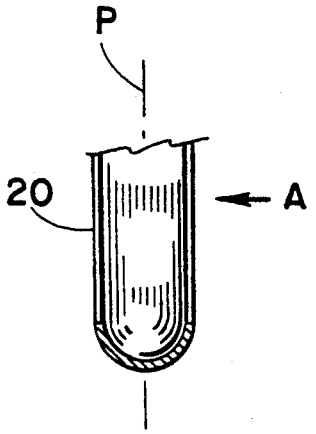
FIG. 2 (PRIOR ART)
FIG. 2 is a partial-sectional view taken along line 2—2 of FIG. 1, also showing the prior art construction.
Figure 3:
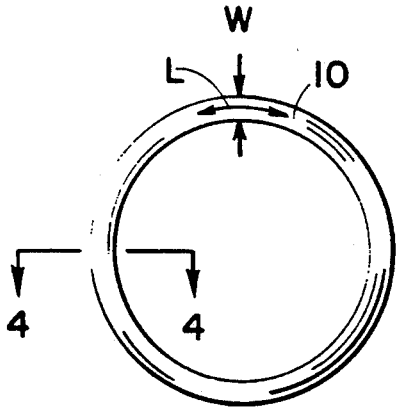
FIG. 3 is a front-elevational view of a half-tubular member of jewelry of the present invention, viewed in a primary plane of the jewelry.
Figure 4:
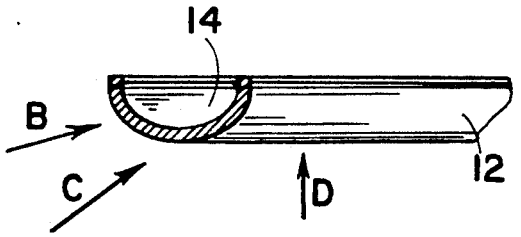
FIG. 4 is a partial-sectional view taken along line 4—4 of FIG. 3.

Referring to the drawings in particular, the invention embodied in FIGS. 3 and 4 comprises a half-tubular arcuate element 10 which, in the embodiment of FIG. 3, is a closed ring that is elongated along a longitudinal direction which lies in a primary plane of a piece of jewelry. The primary plane is the plane of the page in FIG. 3 and ring 10 if outfitted with a pin or earring post can itself be a completed piece of jewelry.

FIG. 4 is a sectional view of FIG. 3 taken along a plane transverse to the primary plane.

The inventor has found that if the arched half-tubular element 10 has a highly, preferably mirror polished convex surface 12 and also a highly polished, preferably mirror finished inner concave surface 14, that a viewer viewing the jewelry, even from an acute angle perspective B shown in FIG. 4, will see the half-tubular member 10 as being fully tubular. It is believed that this illusion is due to the polished inner and outer surfaces which fool the eye into thinking it is seeing fully tubular or cylindrical shapes, where in fact, the shape is only half-tubular. The illusion is even greater at shallower acute angle C, and at angle D no possible hint exists that the element is half-tubular even upon close inspection. The inner concave surface 14 is polished so that reflections give the illusion that the inner surface is convex rather than concave. This is a direct inherent function of the inner surface being polished. It is also noted that the half-tubular member has a half-tubular shape formed by the inner and outer polished convex and concave surfaces and that the half-tubular member has a main curvature in the primary plane of a piece of jewelry containing the member, the width of the half-tubular member being small compared to the circumferential length along the main curvature.

The advantages of the invention are clear in that half as much precious metal need be used and still, a fully tubular effect is achieved.

The illusion is further advanced by the fact that the arcuate member 10 has a width W which is relatively small compared to its longitudinal length in direction L. The longitudinal length in FIG. 3 is the circumference of ring 10 while in the embodiment of FIG. 11, the longitudinal length is the length of one of the arcuate sections 40 making up the multi-part piece of jewelry shown in that figure.

It has been found advantageous to restrict the width-to-length to between 1:15 to 1:60.

The maximum width W should also be 1/16 of an inch since widths any larger would be easier to perceive as half tubular structures, dissipating the effect of the illusion.

Figure 5:
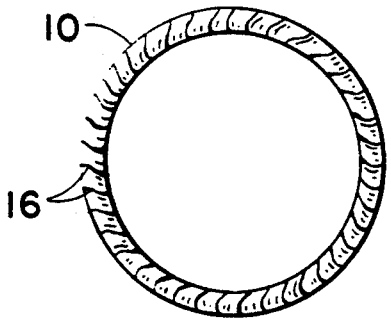
FIG. 5 is a view similar to FIG. 4 showing another embodiment of the half-tubular element which is ribbed to produce a rope effect.

FIG. 5 shows an embodiment of the invention where, as with the remaining figures in the application, the same reference numerals are utilized to designate the same or functionally similar parts. Ring 110 rather than having a smooth cylindrical surface as in the embodiment of FIG. 3, has a cylindrical surface in to which grooves 16 are formed to produce a rope effect. As with the embodiment of FIG. 3, however, the inner and outer surfaces are polished to a mirror finish, including hand-polishing against a polishing brush or wheel.

Hand-polishing is done both on the outer convex and inner concave surfaces.

Figure 6:
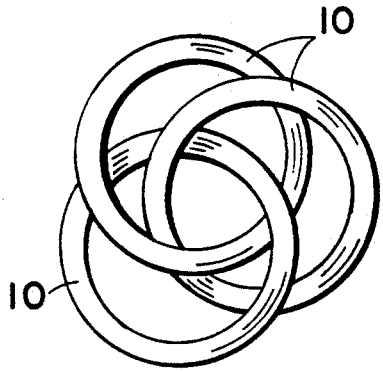
FIG. 6 is front-elevational view of a piece of jewelry according to the invention comprising three half-tubular elements which are intertwined.

FIG. 6 is an embodiment of the invention where three ring-shaped half-tubular members are inter-linked. The embodiments of FIGS. 5 and 6 have their primary planes in the page.

Figure 7:
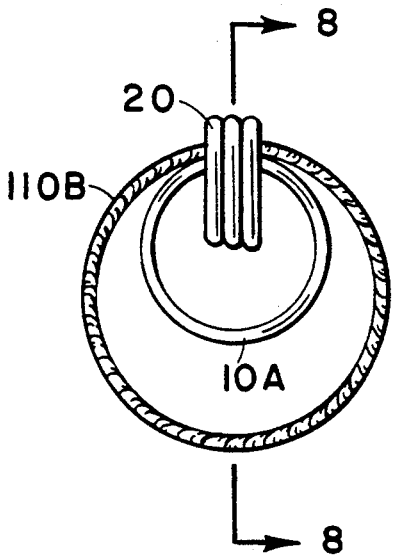
FIG. 7 is a front-elevational view of another piece of jewelry comprising two of the half-tubular elements of the present invention and three half-tubular elements of the prior art.
Figure 8:
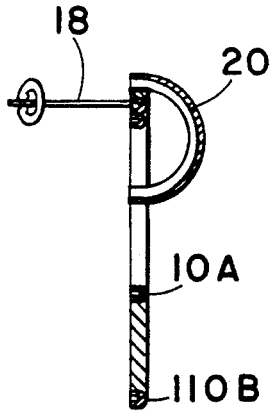
FIG. 8 is a sectional view taken along line 8—8 of FIG. 7.

FIGS. 7 and 8 show an embodiment of the invention where a small smooth ring member 10A and a large grooved ring member 110B are soldered together with the junction being covered by three semi-circular ring portions 20 of the prior art. FIG. 8 is a sectional view of FIG. 7 which is transverse to the primary plane of the piece of jewelry and shows the direction of earring post 18 soldered to the larger ring 10B and extending out of the primary plane.

Figure 9:
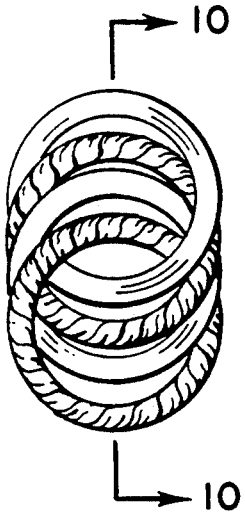
FIG. 9 is a front-elevational view of another piece of jewelry with four intertwined half-tubular rings of the present invention, two with smooth surfaces and two with rope surfaces.
Figure 10:
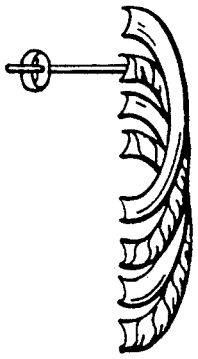
FIG. 10 is a sectional view taken along line 10—10 of FIG. 9.

FIGS. 9 and 10 show another embodiment of the invention with four inter-linked rings of the present invention. Again, due to the highly polished inner and outer surfaces, even from the side (FIG. 10), the observer will actually have the illusion that each ring is fully tubular and not only half-tubular.

Figure 11:
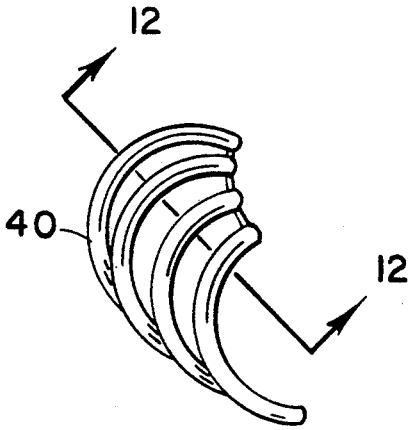
FIG. 11 is a front-elevational view of another piece of jewelry using half-tubular members of the invention which are arcuate but not fully ring-shaped.
Figure 12:
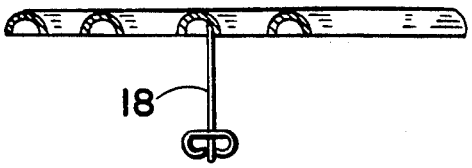
FIG. 12 is a sectional view taken along line 12—12 of FIG. 11.

FIGS. 11 and 12 illustrate an embodiment of the invention using arcuate sections of the half-tubular member soldered together to form an earring having a primary plane in the plane of FIG. 11 and an earring post 18 extending transversely to the primary plane. Each half-tubular member is open-ended with opposite open ends.

Figure 13:
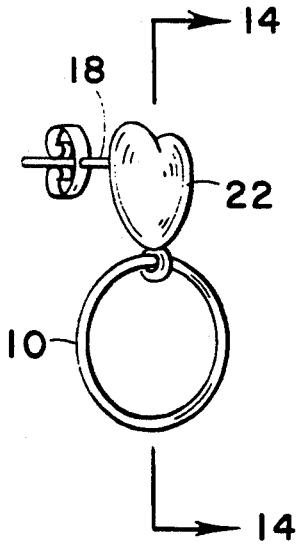
FIG. 13 is a perspective view of a hanging earring including one element according to the present invention and one stamped element.
Figure 14:
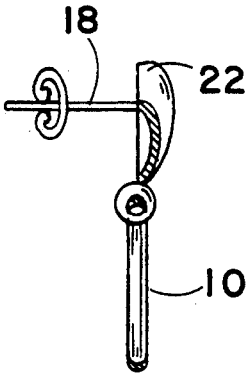
FIG. 14 is a sectional view taken along line 14—14 of FIG. 12.

FIGS. 13 and 14 show another embodiment of the invention where a half-tubular ring 10 of the present invention is engaged with a heart-shaped stamping 22 to form the jewelry piece of FIG. 13 having a post 18 extending transversely to the primary plane of jewelry. FIG. 14 is taken transversely to the primary plane.

Figure 3B:
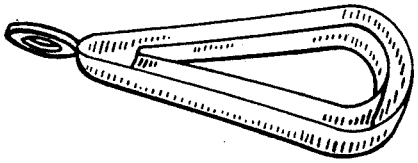
FIG. 3B is another embodiment of the invention where the half-tubular member is tear-drop shaped.

The present invention can also be used as a pendant where, rather than an earring post, a loop is soldered to the top of the jewelry and receives a chain for engagement around the neck of wearer (see FIG. 3B).

Figure 3A:
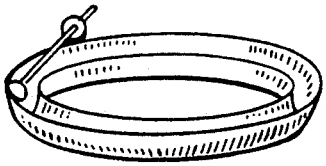
FIG. 3A is perspective view better illustrating the shape of the half-tubular element.

Alternately, the post can be replaced by a pin so that the jewelry is in the form of a broach (FIG. 3A).

By having a main curvature of the half-tubular member, whether it is a fully closed ring of FIG. 3 or a partial-arch or open loop of FIG. 11, keeping the main curvature in the primary plane ensures that most of the time, observations are from front or an acute angle to the side, but only rarely entirely edge-wise to the jewelry. This reduces the chances that an observer will ever perceive that rather than viewing jewelry made of fully tubular members, only half-tubular members are used.

Although semi-cylindrical convex and concave surfaces are shown in the drawings, other shapes may also be used such as parabolic curvatures, random curvatures or even V-shaped cross sections.

The main curvature also need not be a circular curvature but may be any other curvature.

While ring (FIG. 3) and tear-drop (FIG. 3B) shapes have been shown in the drawings, the ring may also be heart-shaped, triangular or take any other non-circular shape.

A pin used as an attachment to produce a broach is shown in FIG. 3A while a loop for producing a pendant and attached to the half-tubular member is shown in FIG. 3B.

All parts of each of the embodiments shown is advantageously made of precious metal, e.g. gold, and the parts can be formed by stamping.

While a specific embodiment of the invention has been shown and described in detail to illustrate the application of the principles of the invention, it will be understood that the invention may be embodied otherwise without departing from such principles.

What is claimed is:

1. A piece of jewelry with a tubular appearance extending outwardly from a primary plane, comprising:

at least one half-tubular member having a half-tubular shape, the member having an outer polished convex surface and an inner polished concave surface, the convex and concave surfaces curving first away from and then toward the primary plane to form said half-tubular shape, and wherein the half-tubular member has a main curvature in the primary plane, the half-tubular member having a width which is small compared to a circumferential length of the half-tubular member along the main curvature, whereby even at acute angles to the primary plane, the half-tubular member appears to be a fully tubular member.

2. A piece of jewelry according to claim 1, including a plurality of half-tubular members, each of said members having a main curvature with polished inner and outer concave surfaces, attached to each other and each lying substantially in the primary plane.

3. A piece of jewelry according to claim 2, wherein each half-tubular member is at least part of a loop and the plurality of members are inter-linked.

4. A piece of jewelry according to claim 1, wherein the main curvature of the half-tubular member forms a closed shape in the primary plane.

5. A piece of jewelry according to claim 4, wherein the closed shape is a circular loop.

6. A piece of jewelry according to claim 1, including fastening means extending substantially transversely to the primary plane for attaching the piece of jewelry.

7. A piece of jewelry according to claim 6, wherein the attachment means comprises an earring post.

8. A piece of jewelry according to claim 6, wherein the attachment means comprises a loop attached to the half-tubular member for receiving a chain.

9. A piece of jewelry according to claim 6, wherein the attachment means comprises a pin attached to the half-tubular member.

10. A piece of jewelry according to claim 1, wherein the half-tubular member has a width-to-length ratio of between 1:10 and 1:60.

11. A piece of jewelry according to claim 10, wherein the width is less than 1/16 of an inch.

12. A piece of jewelry according to claim 1, including a plurality of half-tubular members, each half-tubular member being a closed loop and the closed loops being intertwined with each other.

13. A piece of jewelry according to claim 12, wherein all of the half-tubular members are made of precious metal.

14. A piece of jewelry according to claim 1, including a plurality of open-ended half-tubular members, each having opposite ends.

15. A piece of jewelry according to claim 14, wherein all of the half-tubular members are made of precious metal.

16. A piece of jewelry according to claim 1, wherein the half-tubular member is made of precious metal.

* * * * *